US007564330B2

(12) United States Patent
Pickhard et al.

(10) Patent No.: US 7,564,330 B2
(45) Date of Patent: Jul. 21, 2009

(54) REED SWITCH CONTACT COATING

(75) Inventors: Mark Pickhard, Lake Mills, WI (US); John Wineke, Lake Mills, WI (US); David Lea, Johnson Creek, WI (US); Andrew Petraszak, Lake Mills, WI (US); Steve Topel, Lake Mills, WI (US); Tom Lenz, Fort Atkinson, WI (US)

(73) Assignee: Key Safety Systems, Inc., Sterling Heights, MI (US)

( * ) Notice: Subject to any disclaimer, the term of this patent is extended or adjusted under 35 U.S.C. 154(b) by 268 days.

(21) Appl. No.: 11/736,612

(22) Filed: Apr. 18, 2007

(65) Prior Publication Data

US 2008/0258852 A1 Oct. 23, 2008

(51) Int. Cl.
*H01H 1/66* (2006.01)
*H01H 1/02* (2006.01)

(52) U.S. Cl. ..... 335/151; 335/196; 200/269; 200/270

(58) Field of Classification Search ..... 335/83, 335/97, 151–154, 196, 205–207; 200/262–270
See application file for complete search history.

(56) References Cited

U.S. PATENT DOCUMENTS 3,188,426 A 6/1965 Wessel
3,251,121 A 5/1966 Prival
3,818,392 A 6/1974 Guichard
3,889,098 A 6/1975 Steinmetz et al.
4,129,765 A 12/1978 Herklotz et al.
4,680,438 A 7/1987 Witting
5,847,632 A 12/1998 Oshima
5,883,556 A 3/1999 Shutes

FOREIGN PATENT DOCUMENTS

EP 0612085 A2 8/1994
JP 2004288557 A 10/2004

OTHER PUBLICATIONS

"MDSR-7 Features and Benefits", Hamlin data sheet, Jan. 5, 2003.
"FLEX-14 Features and Benefits", Hamlin data sheet, Jan. 3, 2007.
"MDCG-4 Features and Benefits", Hamlin data sheet, Jan. 5, 2003.

*Primary Examiner*—Ramon M Barrera
(74) *Attorney, Agent, or Firm*—Lonnie Drayer; Patrick Steinnon

(57) ABSTRACT

A reed switch has a contact surface composed of three layers of metal applied to the contacts of the reed switch. The three layers comprise first a layer of titanium of approximately 15 to 150 micro inches, second a layer of molybdenum of 15 to 150 micro inches, and finally a contact layer of 5 to 20 micro inches of ruthenium, or other platinum group metal or alloy. The layers may be applied by any suitable methods, for example by sputtering.

18 Claims, 4 Drawing Sheets

FIG. 4

MDCG-4 TEST DATA

| Load Voltage | 200 VDC | 100 VDC | 100 VDC | 50 VDC | 50 VDC | 28 VDC | 24 VDC | 24 VDC | 20 VDC | 14 VDC | 5 VDC | 120 VAC | 120 VAC |
|---|---|---|---|---|---|---|---|---|---|---|---|---|---|
| Load Current | 20 ma | 100 ma | 10 ma | 100 ma | 10 ma | 350 ma | 100 ma | 10 ma | 500 ma | 14 ma | 10 ma | 100 ma | 10 ma |
| PI Tested | 13-15 AT | 10-12.5 AT | 12.5-15 AT | 13-15 AT | 17-20 AT | 10-12.5 | 17-20 AT | 12.5-15 AT | 17-20 AT | 12.5-15 AT | 7-10 AT | 15-17 AT | 15-17 AT |
| MDCG-4 Cu34, Ru50 wc | PASS | FAIL | PASS | PASS | FAIL | PASS | FAIL | PASS | PASS | FAIL | PASS | PASS | FAIL |
| MDCG-4 DIFFERENT TEST | PASS | PASS | PASS | PASS | PASS | | FAIL | PASS | PASS | | PASS | PASS | PASS |
| MDCG-4 Cu40, Ru40 | PASS | PASS | PASS | PASS | PASS | PASS | PASS | PASS | PASS | FAIL | PASS | PASS | |
| Ti45, Ru35 | PASS | PASS | PASS | PASS | PASS | PASS | PASS | PASS | PASS | FAIL | FAIL | PASS | PASS |
| Ti55, Ru25 | PASS | PASS | FAIL | PASS | PASS | | PASS | PASS | FAIL | PASS | FAIL | PASS | PASS |
| Ti60, Ru20 | FAIL | PASS | PASS | PASS | PASS | PASS | PASS | PASS | PASS | PASS | PASS | FAIL | PASS |
| Stiffer Reed Ti60, Ru20 | PASS | PASS | FAIL | PASS | PASS | PASS | PASS | PASS | PASS | PASS | FAIL | FAIL | PASS |
| Ti65, Ru15 | PASS | PASS | FAIL | PASS | PASS | | PASS | PASS | PASS | PASS | FAIL | PASS | PASS |
| Ti50, Mo15, Ru20 | FAIL | PASS | PASS | PASS | PASS | PASS | PASS | PASS | PASS | PASS | PASS | FAIL | PASS |
| Ti45, Mo20, Ru20 | PASS | PASS | PASS | PASS | PASS | PASS | PASS | PASS | PASS | PASS | PASS | PASS | PASS |
| Ti35, Mo30, Ru20 | PASS | PASS | PASS | PASS | PASS | PASS | PASS | PASS | PASS | PASS | PASS | PASS | PASS |
| Ti30, Mo35, Ru20 | PASS | PASS | PASS | PASS | PASS | PASS | PASS | PASS | PASS | FAIL | PASS | FAIL | PASS |
| Ti45, (Ru10, Mo20)/4, Ru10 | PASS | PASS | PASS | PASS | PASS | PASS | PASS | PASS | PASS | FAIL | FAIL | PASS | PASS |
| Ti42, Mo28, Ru15 | FAIL | PASS | PASS | PASS | PASS | PASS | PASS | PASS | PASS | FAIL | PASS | FAIL | FAIL |
| Ti35, Mo35, Ru15 | FAIL | PASS | PASS | PASS | PASS | PASS | PASS | PASS | PASS | FAIL | PASS | FAIL | PASS |
| Ti30, Mo40, Ru15 | FAIL | PASS | PASS | PASS | PASS | PASS | PASS | FAIL | PASS | FAIL | FAIL | FAIL | PASS |
| Ti35, Mo40, Ru10 | FAIL | PASS | PASS | PASS | PASS | PASS | PASS | PASS | PASS | FAIL | PASS | FAIL | PASS |
| Ti25, Mo50, Ru10 | FAIL | PASS | PASS | PASS | PASS | PASS | PASS | FAIL | PASS | FAIL | FAIL | FAIL | FAIL |
| Ti40, Mo40, Ru5 | FAIL | PASS | PASS | PASS | PASS | PASS | PASS | PASS | PASS | FAIL | PASS | FAIL | FAIL |
| Ti42, Mo42 | FAIL | PASS | PASS | PASS | PASS | PASS | PASS | FAIL | PASS | PASS | FAIL | FAIL | FAIL |
| Cu25, Ti25, Ru30 | PASS | PASS | PASS | PASS | FAIL | | PASS | PASS | PASS | FAIL | FAIL | PASS | PASS |
| Ti40, Cu20, Ru20 | | | | | | | | PASS | FAIL | | PASS | FAIL | FAIL |
| (Cu22, Ti44)/4, Ru20 | | PASS | | | PASS | | PASS | PASS | FAIL | | PASS | FAIL | PASS |
| (Cu13.2, Ti53.2)/4, Ru20 | | PASS | | | PASS | | PASS | PASS | FAIL | | PASS | FAIL | PASS |
| (Cu44, Ti22)/4, Ru20 | | PASS | | | | | PASS | FAIL | FAIL | | FAIL | | |
| (Cu33, Ti33)/4, Ru20 | | PASS | | | | | PASS | FAIL | FAIL | | FAIL | | |
| (Cu18, Ti36)/4, Ru30 | | | | | | | PASS | FAIL | FAIL | | FAIL | PASS | PASS |
| (Cu11, Ti44)/4, Ru30 | | | | | | | PASS | PASS | FAIL | | FAIL | PASS | FAIL |
| Cu30, (Ti21, Ru9)/3, Ru15 | | | | PASS | | | PASS | FAIL | PASS | | PASS | FAIL | FAIL |

FIG. 5

MDSR-7 TEST DATA

| Load Voltage | 200 VDC | 100 VDC | 50 VDC | 50 VDC | 24 VDC | 24 VDC | 20 VDC | 14 VDC | 10 VDC | 5 VDC | 120 VAC |
|---|---|---|---|---|---|---|---|---|---|---|---|
| Load Current | 20 ma | 100 ma | 100 ma | 10 ma | 100 ma | 10 ma | 500 ma | 14 ma | 100 ma | 10 ma | 100 ma |
| PI Tested | 12.5-15 AT | 10-12.5 AT | 12.5-15 AT | 15-17.5 | 12.5-15 AT | 12.5-15 AT | 15-16 AT | 10-12.5 AT | 10-12.5 AT | 10-12.5 AT | 15-17 AT |
| Std (Ti60, Ru35) | PASS | PASS | PASS | PASS | PASS | PASS | PASS | PASS | PASS | PASS | PASS |
| Ti55, Mo20, Ru15 | PASS | PASS | **FAIL** | PASS | PASS | PASS | PASS | **FAIL** | PASS | PASS | PASS |
| Ti40, Mo30, Ru20 | PASS | PASS | PASS | **FAIL** | PASS | **FAIL** | PASS | **FAIL** | PASS | PASS | PASS |
| Ti40, Mo35, Ru15 | PASS | PASS | PASS | PASS | PASS | PASS | PASS | PASS | PASS | PASS | PASS |
| Ti30, Mo45, Ru15 | PASS | PASS | PASS | PASS | PASS | **FAIL** | PASS | PASS | PASS | PASS | PASS |
| Ti40, Mo40, Ru10 | PASS | PASS | PASS | PASS | PASS | PASS | PASS | PASS | PASS | PASS | PASS |

FIG. 6

FLEX-14 TEST DATA

| Load Voltage | 200 VDC | 100 VDC | 100 VDC | 50 VDC | 50 VDC | 24 VDC | 24 VDC | 20 VDC | 14 VDC | 10 VDC | 5 VDC | 120 VAC |
|---|---|---|---|---|---|---|---|---|---|---|---|---|
| Load Current | 20 ma | 100 ma | 10 ma | 100 ma | 10 ma | 100 ma | 10 ma | 500 ma | 14 ma | 100 ma | 10 ma | 100 ma |
| PI Tested | 12.5-15 AT | 10-12.5 AT | 10-12.5 AT | 12.5-15 AT | 17-20 AT | 12.5-15 AT | 12.5-15 AT | 17-20 AT | 12.5-15 AT | 10-12.5 AT | 7-10 AT | 15-17 AT |
| FLEX-14 65/20 TI/RU | PASS | PASS | PASS | PASS | PASS | PASS | PASS | PASS | PASS | PASS | PASS | PASS |
| 35/30/15 TI/MO/RU (80) | PASS | PASS | PASS | PASS | PASS | PASS | PASS | PASS | PASS | PASS | PASS | PASS |
| 35/40/10 TI/MO/RU (85) | PASS | PASS | PASS | PASS | PASS | PASS | PASS | PASS | PASS | PASS | PASS | **FAIL** |
| 35/35/10 TI/MO/RU (80) | PASS | PASS | PASS | PASS | PASS | PASS | PASS | PASS | PASS | PASS | PASS | PASS |
| 35/40/05 TI/MO/RU (80) | PASS | PASS | PASS | PASS | PASS | PASS | **FAIL** | PASS | PASS | PASS | PASS | PASS |

REED SWITCH CONTACT COATING

FIELD OF THE INVENTION

The present invention relates to reed switches in general and to surface coatings on reed switch contacts in particular.

BACKGROUND OF THE INVENTION

Reed switches are electromechanical switches having two reed blades formed of a conductive ferromagnetic material, typically a ferrous nickel alloy. In the presence of a magnetic field the overlapping reed blades attract, causing the blades to bend towards each other and make contact, closing an electrical circuit. The two reed blades are positioned within a glass capsule hermetically sealing the reed blades. The capsule typically contains a vacuum, air, or nitrogen at atmospheric or super atmospheric pressure. Reed switches can switch significant power, for example in the range of 10 to 100 Watts. Reed switches also have a long life measured in millions to over 100 million operations without failure or significant increase in contact resistance. Over many cycles the reed contacts can become worn, pitted, or eroded, due to mechanical wear or the electrical arcing as the switch opens and closes. This pitting or corrosion results in an increase in electrical resistance across the closed switch. To prevent, or at least minimize, such erosion the contact surfaces of the reed blades are coated with ruthenium, a hard, high melting temperature metal with relatively low resistivity. Recently the cost of ruthenium has dramatically increased. Known reed switch contact coatings include, for example, a gold layer overlain by a layer of ruthenium, or a layer of titanium of 50-65 micro inches thickness overlain by a layer of ruthenium of 20-35 micro inches, a layer of molybdenum overlain by a layer of ruthenium or a layer of copper 34 micro inches overlain by a layer of ruthenium of 50 micro inches.

What is needed is a reed switch contact arrangement which minimizes the amount of ruthenium or other platinum group metal on the contact faces without decreasing reed switch life.

SUMMARY OF THE INVENTION

The reed switch of this invention employs a contact surface composed of three layers applied to the contacts of the reed blades. The three layers comprise a metal layer that wears flat, a refractory metal layer, and a platinum group metal or platinum group metal alloy layer. The first layer is constructed of titanium metal of 15 to 60 micro inches in thickness. Titanium tends not to form pits and valleys when subject to wear as a reed switch contact surface. The second layer is molybdenum, of 15 to 150 micro inches thickness. Molybdenum has a melting temperature of 2623° C., 4753° F. and a Brinell hardness of 1500 Mpa. The final layer and contact surface is 5 to 75 micro inches of ruthenium. The layers may be applied by any suitable method, particularly reactive ion sputtering.

It is a feature of the present invention to provide a reed switch contact coating of long life and lower cost.

Further features and advantages of the invention will be apparent from the following detailed description when taken in conjunction with the accompanying drawings.

BRIEF DESCRIPTION OF THE DRAWINGS

FIG. 4 is a table of experimental data for reed switch contact life testing for a first reed switch.

FIG. 5 is a table of experimental data for reed switch contact life testing for a second reed switch.

FIG. 6 is a table of experimental data for reed switch contact life testing for a third reed switch.

DETAILED DESCRIPTION OF THE INVENTION

Figure 1:
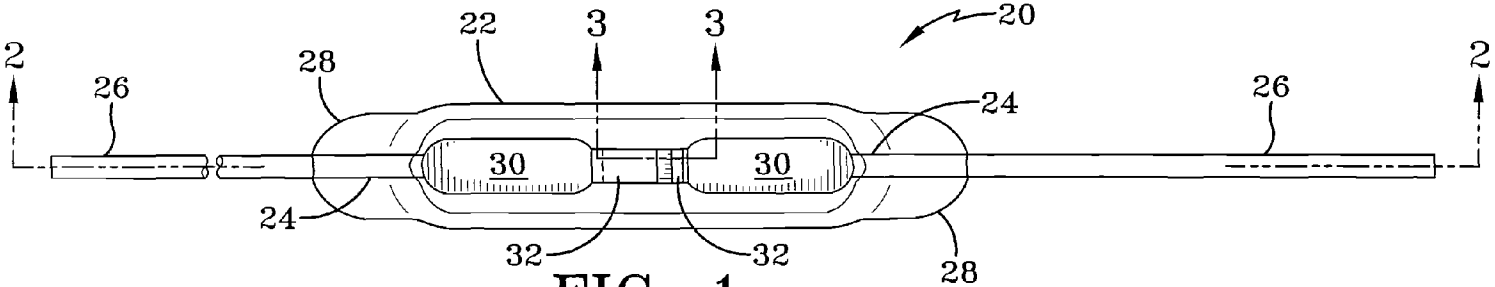
FIG. 1 is a top cross-sectional view of a reed switch employing the contact coating of this invention.
Figure 2:
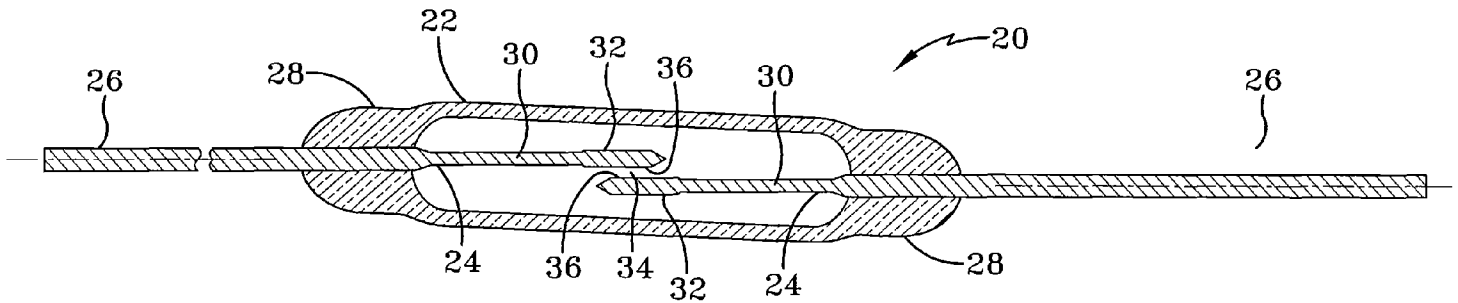
FIG. 2 is a cross-sectional view of the reed switch of FIG. 1, taken along section line 2-2.
Figure 3:
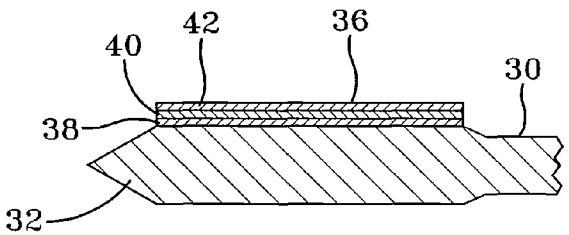
FIG. 3 is a side cross-sectional view of the reed switch contact of FIG. 2 with the contact surface coating layers exaggerated in thickness for illustrative purposes.

Referring more particularly to FIGS. 1-6, wherein like numbers refer to similar parts, a reed switch 20 is shown in FIGS. 1 and 2. The reed switch 20 is of the so called "Form A" type having an axially extending cylindrical glass capsule 22. Two reed blades 24 extend into a hermetically sealed volume defined by the glass capsule 22. Each reed blade 24 has a lead 26 that extends through one opposed axial end 28 of the glass capsule 22. The opposed ends 28 of the glass capsule are heated and fused to the lead 26 of each reed blade 24, thus positioning the reed blades with respect to each other and forming a hermetic seal and enclosing the capsule volume. The capsule volume typically contains either a vacuum or an inert gas such as nitrogen or argon, sometimes at above atmospheric pressures.

A portion 30 of each reed blade 24 is flattened, producing a controlled spring constant which controls the force required to close the reed switch 20. Each reed switch blade 24 terminates in a contact 32. The contacts 32 of the reed blades 24 overlap defining a contact gap or space 34 therebetween. Each contact 32 has a contact surface 36. The contact surfaces 36 face each other across the contact gap 34.

The reed switch blades 24 are formed of a ferromagnetic alloy, typically an alloy of nickel and iron having a composition of 51-52 percent nickel. In the presence of a magnetic field such as generated by an electrical coil or a permanent magnet, the magnetic field permeates the reed blades 24, causing the reed blades to attract each other. The attraction force causes flexure of the flexible portions 30 of the reed blades so that the contacts 32 close the contact gap 34, thus bringing the contact surfaces 36 into engagement and completing an electrical circuit between the leads 26. When the magnetic field is removed a magnetic field no longer permeates the reed blades 24 and the contacts 32 separate, reestablishing the contact gap 34, and breaking the electrical circuit between the leads 26.

A reed switch can switch a load of between 10 and 100 Watts or more, at voltages up to or exceeding 500 volts DC. When the switch is under load an electric arc can form between the contact surfaces 36 upon opening or closing of the reed switch 20. Furthermore, mechanical wear can occur between the surfaces during repeated opening and closing of the reed switch 20. As reed switches are normally designed with lifetimes of 1 million to 100 million operations or more over the lifetime of the reed switch, it is desirable that the contact resistance does not substantially increase, e.g. does not increase by more than 50 percent. To prevent an increase in contact resistance the contact surfaces 36 are coated with three juxtaposed layers: First, a layer 38 of titanium metal deposited directly on to the ferromagnetic contact 32; second, a layer 40 of molybdenum metal is deposited over the titanium layer; and finally a third layer 42 of a platinum group metal or metal alloy is deposited over the molybdenum. Preferably the platinum group metal is selected from the group consisting of ruthenium, rhodium, osmium, and iridium, or other platinum group alloy with a Brinell hardness of over 1000 Mpa.

The thickness of the three layers can range, for example, from about 15 micro inches to about 150 micro inches for each of the titanium and the molybdenum layers, and between about 5 micro inches and 75 micro inches for the platinum group metal layer, which will preferably be a layer of ruthenium. When replacing the contact coating arrangement in existing reed switch designs, the total thickness of the three layers of titanium, molybdenum, and the platinum group metal, can be selected to have the same total thickness as the original contact coating. In this way the design of the reed switch itself need not be modified. As a starting point for a design the thickness of the titanium and molybdenum layers may be approximately equal and the thickness of the platinum group metal layer will be less than the thickness of either of the titanium or the molybdenum layers to minimize cost. A titanium layer much greater than 50 micro inches may not be desirable such that if the total thickness needs to be increased beyond about 100 micro at some point the molybdenum layer may be substantially greater than the titanium layer.

Three designs were built and tested, the first design utilized the Hamlin reed switch MDCG-4 and consisted of a layer of 35 micro inches ion sputtered titanium on top of which was deposited a second layer of 30 micro inches of ion sputtered molybdenum, followed by a third layer of 20 micro inches of ion sputtered ruthenium. Another arrangement which was tested in the Hamlin reed switch MDSR-7 consisted of a layer of 40 micro inches ion sputtered titanium on top of which was deposited a second layer of 38 micro inches of ion sputtered molybdenum, followed by a third layer of 12 micro inches of ion sputtered ruthenium. Finally, the Hamlin reed switch FLEX-14 was tested with three layers consisting of a layer of 35 micro inches ion sputtered titanium on top of which was deposited a second layer of 38 micro inches of ion sputtered molybdenum, followed by a third layer of 7 micro inches of ion sputtered ruthenium. The data sheets for MDCG-4, MDSR-7, and FLEX-14 are incorporated herein by reference.

FIG. 4 is a table of experimental data of life cycle testing of the MDCG-4 reed switch with various coating combinations on the reed switch contacts. Each reed switch contact coating was tested over a range of operating conditions representative of the conditions under which the reed switch is normally employed. The left-hand column of the table lists the type and thickness of the layers used to form the reed switch contacts. The following abbreviations are used:

CU copper
TI titanium
MO molybdenum
RU ruthenium

The number immediately following a symbol for each metal used in forming the contact is the thickness of that metal layer in micro inches, i.e. millions of an inch, μ inches. The following nomenclature (Ru10, Mo20)/4 indicates four layers each of ruthenium alternating with molybdenum, for a total thickness of 10 micro inches and 20 micro inches respectively. The first two rows of FIG. 4 test results show how examples of the prior art MDCG-4 reed switch performed according to the test criteria. Row one shows the worst case from a number of data points, row two shows another data point. The subsequent rows provide the test outcomes for a number of different configurations from which the preferred arrangement was selected.

This experimental data indicates the unexpected nature of the success of the present invention's combination of three metal layers, and that it is difficult to predict how three metal layers can be combined to meet the test criteria. On the other hand, once the general parameters were known only a few combinations were tested to develop coatings of additional reed switch models, namely the Hamlin reed switches MDSR-7 shown in FIG. 5, and FLEX-14 shown in FIG. 6. The final design layer thickness for each of these reed switches, as noted above, were then selected based on the test data.

The term reed switch is intended to embrace all types of reed switch including the "Form A" normally open type illustrated in FIGS. 1 and 2, as well as other reed switch types, particularly the "Form C". The Form C type has at one end of the glass capsule two leads that extend into a hermetically sealed volume defined by the glass capsule. Only one of the two leads is constructed of a ferromagnetic material. At the other end of the glass capsule a ferromagnetic reed blade has a lead that extends into the glass capsule and has a flexible portion within the hermetically sealed volume which is engaged with and biased against the non-ferromagnetic lead when no magnetic field is present. When a magnetic field is present the flexible portion is attracted to, and switches to the ferromagnetic lead. The contact surface coating of this invention may be applied to contact surfaces on both sides of the flexible portion of the reed blade, and the contact surface coating may be applied on contact surfaces on both the ferromagnetic and the non-ferromagnetic leads.

It should be understood that the platinum group metal alloy is an alloy containing more than 50 percent platinum group metals i.e., ruthenium, rhodium, palladium, osmium, iridium, and platinum.

It should be understood that a refractory metal is a metal with a very high melting point selected from the group consisting of molybdenum, tungsten, niobium, tantalum and vanadium.

It is understood that the invention is not limited to the particular construction and arrangement of parts herein illustrated and described, but embraces all such modified forms thereof as come within the scope of the following claims.

The invention claimed is

1. A reed switch comprising:

a glass capsule defining a hermetically sealed volume;

at least a first ferromagnetic lead extending into the hermetically sealed volume;

at least a second ferromagnetic lead extending into the hermetically sealed volume;

the first ferromagnetic lead having a flexible blade portion and a contact portion extending from the flexible blade portion; and wherein the contact surface is coated with a layer of a metal which wears flat when used as a contact in the reed switch, overlain by a layer of a refractory metal, which in turn is overlain by a layer of a platinum group metal or platinum group metal alloy.

2. The reed switch of claim 1 wherein the metal which wears flat when used as a contact in the reed switch is titanium, and wherein the refractory metal is molybdenum.

3. The reed switch of claim 2 wherein the titanium layer is between 15 micro inches to 150 micro inches thick, and wherein the molybdenum layer is between 15 micro inches and 150 micro inches thick, and wherein the layer of a platinum group metal or platinum group metal alloy is between 5 micro inches and 75 micro inches thick.

4. The reed switch of claim 3 wherein the layer of a platinum group metal or platinum group metal alloy is formed of a platinum group metal or platinum group metal alloy having a Brinell hardness of greater than 1000 Mpa.

5. The reed switch of claim 3 wherein the layer of a platinum group metal or platinum group metal alloy is a layer which consists essentially of ruthenium.

6. The reed switch of claim 3 wherein the layer of a platinum group metal or platinum group metal alloy is between 5 micro inches and 20 micro inches thick.

7. The reed switch of claim 3 wherein the titanium layer thickness is within plus or minus 20 percent of the molybdenum layer thickness.

8. The reed switch of claim 3, wherein the titanium layer is between 35 micro inches to 40 micro inches thick, wherein the molybdenum layer is between 30 micro inches and 38 micro inches thick, and wherein the layer of a platinum group metal or platinum group metal alloy is ruthenium of 5 micro inches to 20 micro inches thick.

9. A reed switch comprising:

a glass capsule, defining an interior hermetically sealed volume;

a first reed switch blade having a first lead extending into the glass capsule hermetically sealed volume, wherein the first reed switch blade has a first contact surface positioned within the hermetically sealed volume;

at least a second lead extending into the glass capsule and positioning a second contact surface within the hermetically sealed volume;

wherein at least the first reed switch blade is flexibly movable to engage the second contact surface with the first contact surface; and wherein at least the first contact surface has formed thereon a layer of titanium, the titanium layer being overlain by a layer of molybdenum which is formed on the titanium layer, the molybdenum layer being overlain by a layer of a platinum group metal or platinum group metal alloy which is formed on the molybdenum layer, the layer of a platinum group metal or platinum group metal alloy being outermost so as to engage the second contact surface.

10. The reed switch of claim 9 wherein the titanium layer is between 15 micro inches to 150 micro inches thick, wherein the molybdenum layer is between 15 micro inches and 150 micro inches thick, and wherein the layer of a platinum group metal or platinum group metal alloy is between 5 micro inches and 75 micro inches thick.

11. The reed switch of claim 10 wherein the platinum group metal or platinum group metal alloy has a Brinell hardness of greater than 1000 Mpa.

12. The reed switch of claim 10 wherein layer of a platinum group metal or platinum group metal alloy consists essentially of a layer of ruthenium.

13. The reed switch of claim 10 wherein the layer of a platinum group metal or platinum group metal alloy is between 5 micro inches and 20 micro inches thick.

14. The reed switch of claim 10 wherein the titanium layer thickness is within plus or minus 20 percent of the molybdenum layer thickness.

15. The reed switch of claim 10 wherein the titanium layer is between 35 micro inches and 40 micro inches thick, wherein the molybdenum layer is between 30 micro inches and 38 micro inches thick, and wherein the layer of a platinum group metal or platinum group metal alloy is ruthenium of 5 micro inches to 20 micro inches thick.

16. A method of reducing the cost of a reed switch comprising:

taking an existing reed switch design having a contact coating of a selected thickness, and replacing the contact coating of the selected thickness with a three layer coating having a total thickness which is within plus or minus 10% of the selected thickness, the three layer coating comprised of a layer of titanium, overlain by a layer of molybdenum, which in turn is overland by a layer of a platinum group metal or platinum group metal alloy.

17. The method of claim 16 wherein the layer of a platinum group metal or platinum group metal alloy is between 5 micro inches and 20 micro inches of ruthenium.

18. The method of claim 17 wherein the titanium layer thickness is within plus or minus 20% of the molybdenum layer thickness.

* * * * *